US005418422A

United States Patent [19]

Vink et al.

[11] Patent Number: 5,418,422

[45] Date of Patent: May 23, 1995

[54] COMBINATION OF DISPLAY TUBE AND DEFLECTION UNIT COMPRISING LINE DEFLECTION COILS OF THE SEMI-SADDLE TYPE WITH A GUN-SIDED EXTENSION

[75] Inventors: Nicolaas G. Vink; Johannes Penninga, both of Eindhoven, Netherlands

[73] Assignee: U.S. Philips Corporation, New York, N.Y.

[21] Appl. No.: 39,612

[22] Filed: Mar. 24, 1993

[30] Foreign Application Priority Data

May 6, 1992 [EP] European Pat. Off. ..... 92201275

[51] Int. Cl.[6] ..... H01J 29/76

[52] U.S. Cl. ..... 313/440; 335/212; 335/213

[58] Field of Search ..... 313/440; 335/210–213, 335/296–299

[56] References Cited

U.S. PATENT DOCUMENTS

| | | | |
|---|---|---|---|
| 4,431,940 | 2/1984 | Habraken et al. | 313/440 |
| 4,464,643 | 8/1984 | Meershoek | 335/213 |
| 4,524,340 | 6/1985 | Sluyterman | 335/212 |
| 4,987,398 | 1/1991 | Bessho | 335/296 |
| 5,166,576 | 11/1992 | Roussel et al. | 313/440 |

FOREIGN PATENT DOCUMENTS 0286189 4/1988 European Pat. Off. .

*Primary Examiner*—Stephen Brinich
*Attorney, Agent, or Firm*—Robert J. Kraus

[57] ABSTRACT

A display tube has an electromagnetic deflection unit with line deflection coils of the semi-saddle type which are provided at their gun-sided ends with an extension having one single, wedge-shaped window directed towards the gun. Particularly line coma errors and raster errors, which occur in display tubes having display screens of small curvature and/or in the case of extreme long axis: short axis ratios, can be minimized with such line deflection coils.

4 Claims, 3 Drawing Sheets

COMBINATION OF DISPLAY TUBE AND DEFLECTION UNIT COMPRISING LINE DEFLECTION COILS OF THE SEMI-SADDLE TYPE WITH A GUN-SIDED EXTENSION

BACKGROUND OF THE INVENTION

The invention relates to a display tube comprising an electron gun system, a longitudinal axis, a display screen and an electromagnetic deflection unit, which unit comprises a line deflection coil system having two line deflection coils facing each other.

In monochrome display tubes the electron gun system is adapted to generate one electron beam, whereas in, for example colour display tubes of the in-line type the electron gun system is adapted to generate three coplanar electron beams which converge on the display screen.

The electromagnetic deflection unit for deflecting electron beams is used for deflecting the electron beams in two orthogonal directions from their normal undeflected straight path so that the beams impinge upon selected pixels of the display screen so as to provide visual indications on this screen. The electron beams can be moved up or down or from left to right across the (vertically arranged) display screen by suitably varying the magnetic deflection fields. A visual presentation of information or a picture can be formed on the display screen by simultaneously varying the intensity of the beams. The deflection unit, which is secured to the neck portion of the display tube, comprises two systems of deflection coils for deflecting the electron beams in two directions which are transverse to each other; a line deflection coil system to which a line deflection signal of a higher frequency is applied during operation and a field deflection coil system to which a field deflection signal of a lower frequency is applied during operation. Each system comprises two coils arranged with respect to the tube axis at positions facing each other.

An annular core of magnetizable material surrounding the systems of deflection coils if both systems are of the saddle type, is generally used for concentrating the deflection fields and for increasing the flux density in the deflection area.

To satisfy given requirements of convergence (and raster) quality, magnetic six-pole field components are generally to be added to the (dynamic) magnetic dipole deflection fields. The effect of a positive six-pole component on the dipole deflection field is a pincushion-field variation. The effect of a negative six-pole component is a barrel-shaped field variation.

A pincushion-shaped field is generated when the two coils of a system of deflection coils have large window apertures, whereas a barrel-shaped field is generated when they have small window apertures. For a self-converging system the line deflection field in the central area must be pincushion-shaped (the separate line deflection coils must thus have a large window aperture), while it must be homogeneous, more pincushion-shaped or less pincushion-shaped at the screen side, dependent on the quantity of admissible raster distortion, and barrel-shaped (i.e. small window aperture) at the gun side. (Such a field variation is also referred to as field modulation.) Similar field modulations are also important for monochrome systems of display tubes and deflection units which must have a high resolving power.

The flatter the display screen (for example, "super-flat" display screens), the deeper the field modulations should be to satisfy the convergence and raster requirements.

Until now it has been found impossible to manufacture deflection coils having a window aperture which varies as much as is desired for said applications, while using the conventional winding methods. However, there are different compromise solutions to reduce the required variation. For example, the barrel shape can be increased by means of plates of a soft-magnetic metallic material. The use of metal plates in the deflection field is, however, undesired if the display tube/deflection unit is to be operated at higher frequencies (EVTV, HDTV). In fact, the energy generated by eddy currents in the metal plates cannot be dissipated in a simple manner so that the temperature of the deflection coil(s) may become inadmissibly high.

SUMMARY OF THE INVENTION

It is an object of the invention to provide a display tube of the type described in the opening paragraph with a deflection unit in which line deflection field modulations are realized in a novel way. This novel method should preferably lead to the possibility of omitting the known soft-magnetic metal plates and/or the possibility of having to vary the window apertures to a less extreme extent.

According to the invention, a display tube of the type described in the opening paragraph is therefore characterized in that each line deflection coil has a gun-sided, lying, lobe and a screen-sided lobe and comprises a first, inner winding sub-assembly and a second, outer winding sub-assembly, each winding sub-assembly comprising two longitudinal conductor groups arranged at both sides of the tube, which groups are connected at their screen side by a connection group crossing in the plane of the screen-sided lobe, the second sub-assembly surrounding the first sub-assembly in such a way that one single, wedge-shaped window with its narrower side at the gun side is formed between the sub-assemblies at the gun side.

The term "wedge-shaped window" is herein understood to mean a coil portion which is free from turns and, viewed in the direction of the longitudinal axis of the tube, tapers towards the gun. The boundary at the screen side may have different shapes.

The invention is based, inter alia on the recognition that it should be possible to adjust pre-deflection and six-pole strength independently of each other so as to be able to realise the variations (required for, for example self-convergence) in the distribution of the line deflection field ("line deflection field modulations") in the z direction, and that a coil of the saddle type having a gun-sided, lying lobe, with an "extension" having a wedge-shaped window being formed behind a connection group in the plane of the lobe, provides this possibility in an accurate way. In such coils the use of soft-magnetic metal plates is not necessary, or is necessary to a lesser extent only, and/or, viewed in the direction of the longitudinal axis of the tube, the window apertures need not vary to such a large extent.

Deflection coils of the relevant saddle type are self-supporting coils comprising a plurality of conductors which are wound in such a way that they constitute longitudinal first and second lateral groups which are interconnected by an arcuate front connection group and a lying arcuate rear connection group. As it were, the rear (gun-sided) connection group is arranged "flat", i.e. its conductors are situated in the plane of the lateral group, which plane is parallel to the envelope of the tube.

At the location where the gun-sided connection group of the first sub-assembly is situated between the lateral groups of the second sub-assembly, i.e. proximate to the wider side of the wedge-shaped window, these lateral groups, viewed in a plane transverse to the longitudinal axis of the tube, may subtend a larger or smaller angle to the tube axis. An angle of approximately 120° to 180° subtended with respect to the tube axis generally introduces a positive sixpole field component. A subtended angle of less than 120° generally introduces a negative sixpole field component, with a largest amplitude in the range around 60°. An embodiment is characterized in that viewed in a plane transverse to the longitudinal tube axis the longitudinal conductor groups, arranged at both sides of the tube, of the second sub-assembly subtend an angle of less than 120° with respect to the tube axis proximate to the wider side of the wedge-shaped window. Such a wire arrangement, together with an extension having a wedge-shaped window, yields a deflection field modulation which is very suitable for a number of applications.

Due to the extension with the wedge-shaped window, a substantial negative six-pole field component is generated which leads to a substantial barrel-shaped field component having only a small dipole strength at the gun side of the line deflection field. As will be described hereinafter, such a line deflection field is also eminently suitable in, for example display tubes having a display screen with a 16:9 aspect ratio, in combination with scanning parallel to the short axis.

BRIEF DESCRIPTION OF THE DRAWING

These and other aspects of the invention will be apparent from and elucidated with reference to the embodiments described hereinafter. In the drawing.

DESCRIPTION OF THE PREFERRED EMBODIMENTS

Figure 1:
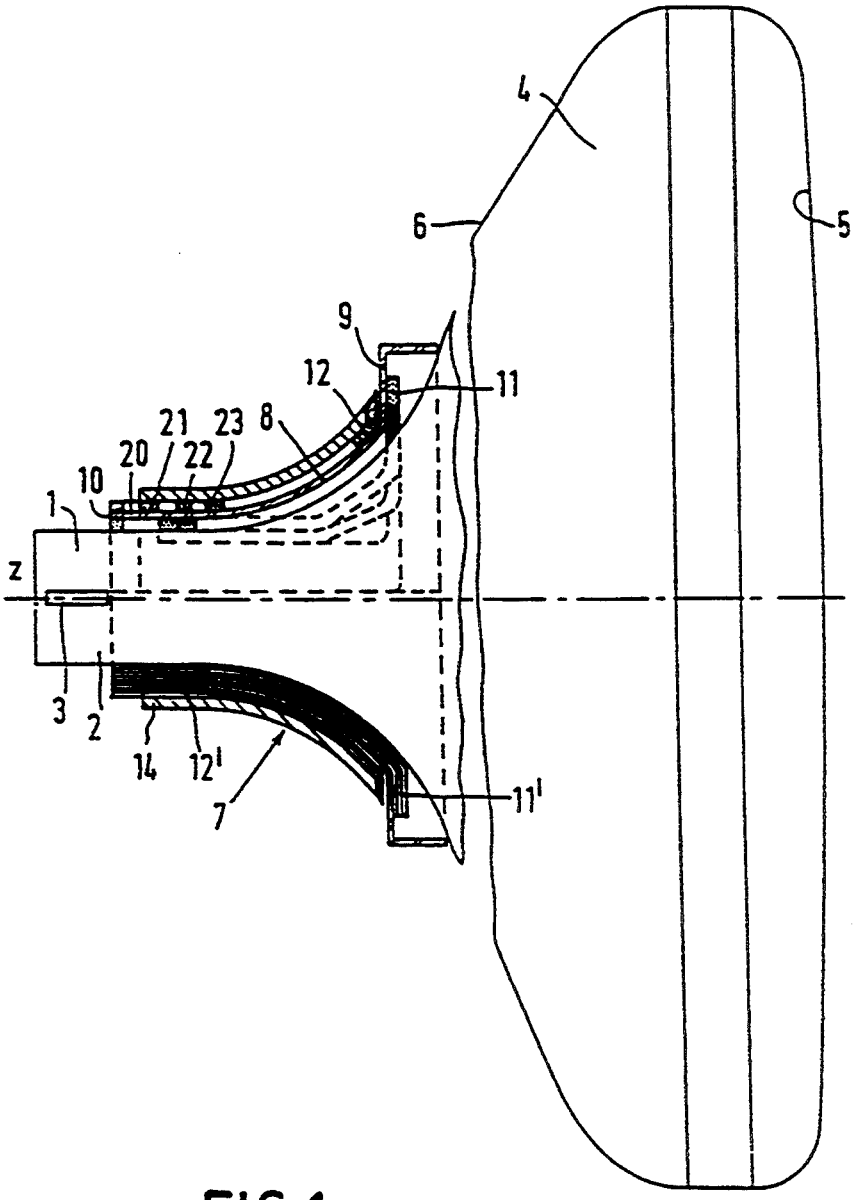
FIG. 1 is a diagrammatic cross-section of a cathode ray tube with a deflection unit mounted on said tube.

FIG. 1 is a cross-section of a display tube 1 having an envelope 6 which extends from a narrow neck portion 2, in which an electron gun system 3 is mounted, to a wide funnel-shaped portion 4 which is provided with a display screen 5. An electromagnetic deflection unit 7 is mounted on the tube at the interface between the narrow and the wide portion. This deflection unit 7 has a support 8 of insulating material, with a front end 9 and a rear end 10. Between these ends 9 and 10 a system of deflection coils 11, 11' for generating a deflection field of a higher frequency for deflecting electron beams produced by the electron gun system 3 in the line direction is present at the inner side of the support 8, and a system of coils 12, 12' for generating a deflection field of a lower frequency for deflecting electron beams produced by the electron gun system 3 in the field direction is present at the outer side of the support. The deflection coil systems 11, 11' and 12, 12' are surrounded by an annular core 14 of magnetizable material. Like the coils 12, 12' of the field deflection coil system, the separate coils 11, 11' of the line deflection coil system are of the saddle type having "flat" rear connection groups (=semi-saddle type).

Figure 2A:
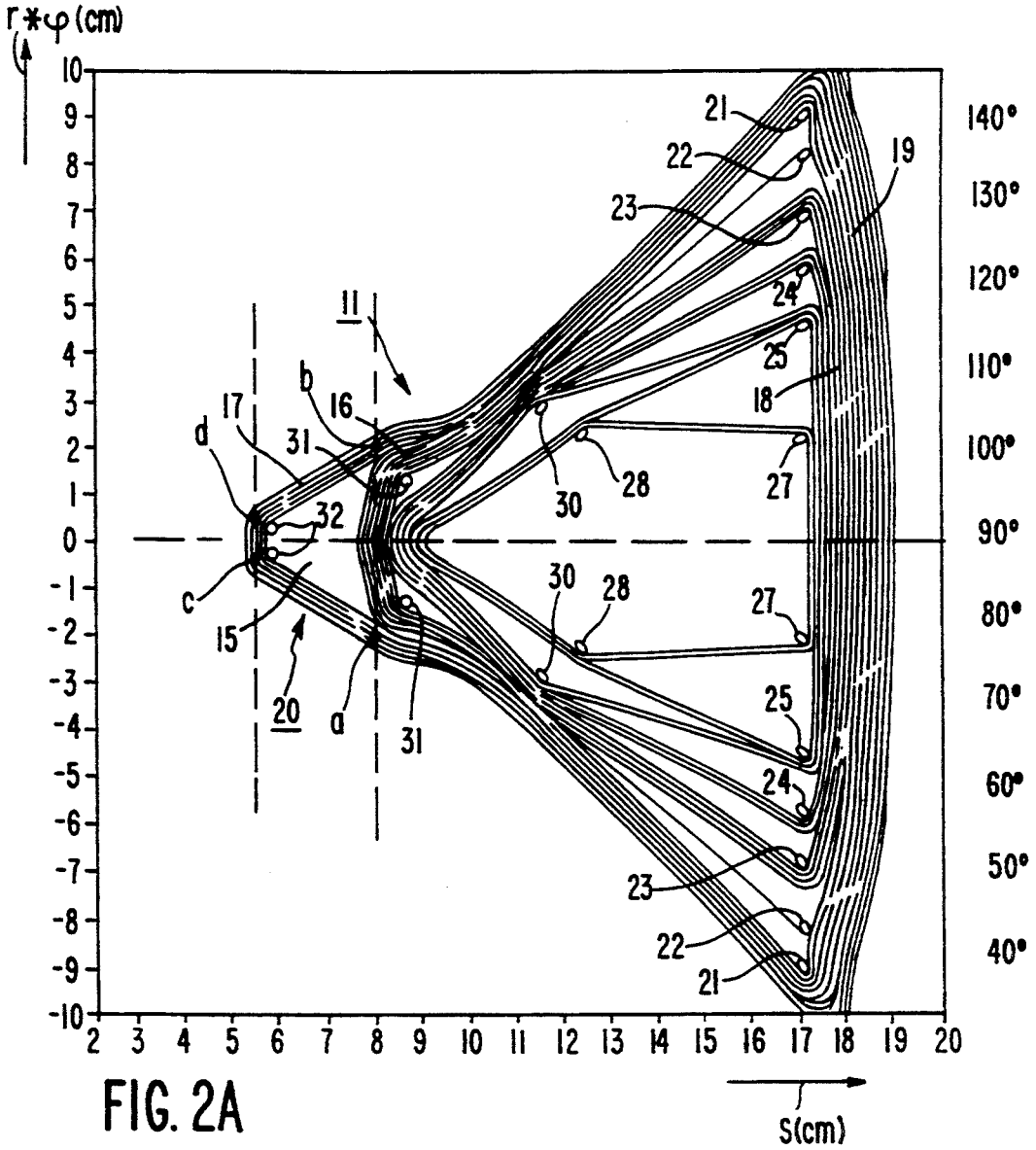
FIG. 2A shows an S-r*$\phi$ diagram of a line deflection coil which is characteristic of the invention.
Figure 2B:
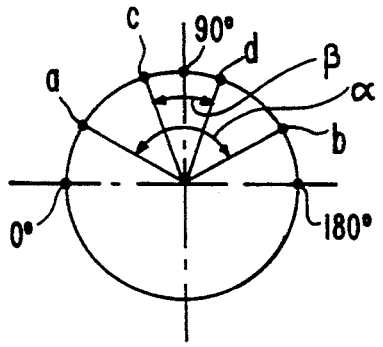
FIG. 2B shows by way of a diagrammatic cross-section the wire arrangements of the wedge-shaped window of the line deflection coil shown in FIG. 2A.

FIG. 2A shows an S-r*$\phi$ diagram of the line deflection coil 11 of the construction shown in FIG. 1 (S is the coordinate of the coil profile in the z-R plane; z is the direction along the longitudinal axis of the tube). There are two winding sub-assemblies 16 and 17 each comprising two facing longitudinal conductor groups, and connection groups 18 and 19, respectively, crossing at the wide end. Winding sub-assembly 16, whose narrow end has a connection group which follows a path extending substantially straight across the tube neck (which path may be slightly curved or even V-shaped in other embodiments), is arranged within sub-assembly 17. Due to this structure the coil 11 has an extension 20 with a wedge-shaped window 15. In a practical embodiment the conductor groups of the extension 20 subtend an angle $\alpha$ at the screen side of less than 120°, particularly between 70° and 110° an preferably between 80° and 100°, and at the screen side an angle $\beta$ which is smaller than $\alpha$ (see FIG. 2B).

Pins 21, 22, 23, 24, 25, 27, 28, 30, 31, 32 are shown which, in this order, have been arranged in the winding jig during winding of the coil so as to obtain the desired structure.

This structure introduces a greater six-pole modulation depth than is feasible with conventional line deflection coils and a substantial six-pole field in combination with hardly any dipole field at the gun side. This is elucidated with reference to FIGS. 3, 4, 5 and 6.

Figure 3:
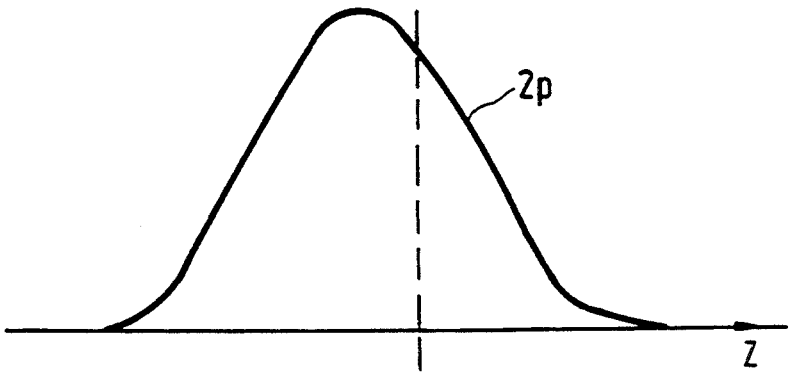
FIGS. 3 and 4 are diagrams showing the dipole field strength and the six-pole field strength along the z axis in the case of a conventional line deflection coil.
Figure 4:
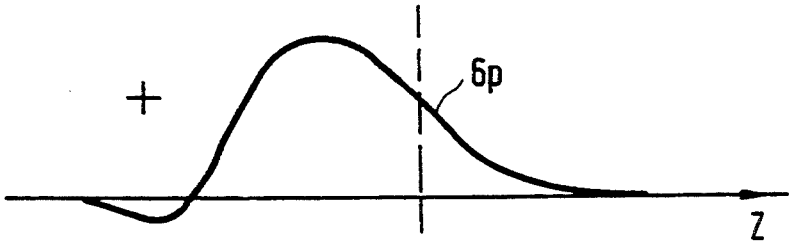

FIG. 3 shows the dipole field strength $2p$ along the z axis and FIG. 4 shows the six-pole field strength $6p$ along the z axis of a conventional line deflection coil. This six-pole modulation is not deep enough for applications within the scope of the invention.

Figure 5:
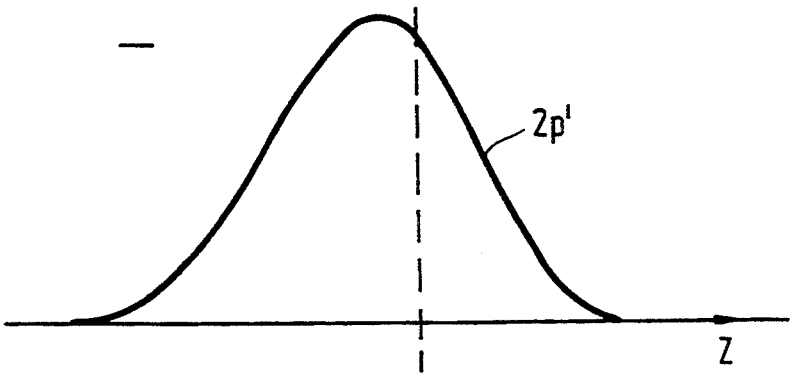
FIGS. 5 and 6 are diagrams showing the dipole field strength and the six-pole field strength along the z axis in the case of a line deflection coil of the type shown in FIG. 2.
Figure 6:
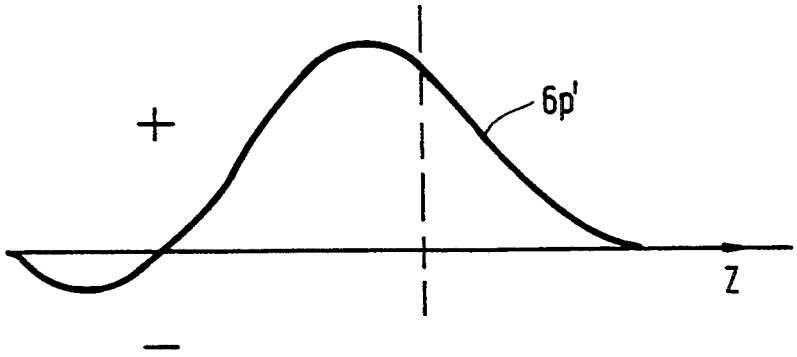

FIG. 5 shows the dipole field strength $2p^1$ and FIG. 6 shows the six-pole field strength $6p^1$ along the z axis of a line deflection coil of the type shown in FIG. 2. A negative six-pole component extending further towards the gun is created in the gun-sided area, while the dipole contribution in this area is very small. The line coma is effectively corrected thereby. The line deflection coils according to the invention are thus generally longer than comparable conventional line deflection coils (hence the term: extension) and have a smaller distance between their gun-sided end and the electron gun than comparable conventional line deflection coils.

Moreover, the six-pole modulation depth (FIG. 6) is increased with respect to the conventional coil (FIG. 4). Particularly line astigmatism is effectively corrected thereby.

A deflection unit with line deflection coils of the type shown in FIG. 2 is not only suitable for use in a system with a display screen having a small curvature, such as display screens of the "flat square" or "super flat" type in particular, but also very suitable in a system having a display screen aspect ratio which is more extreme than 4:3 (for example 16:9) and in an in-line gun system which is arranged parallel to the short field axis. In such a "transposed scan" system the line deflection is effected parallel to the short field axis. Due to the large distance to the electron beams in the direction of the short axis it is not possible to produce the required six-pole field modulations by means of a conventional line deflection coil system so that also in that case the simultaneous correction of line coma and astigmatic errors is not possible with the correct dipole and six-pole field strength.

We claim:

1. A display tube comprising an electron gun system, a longitudinal axis, a display screen and an electromagnetic deflection unit, which unit comprises a line deflection coil system having two line deflection coils facing each other, characterized in that each line deflection coil has a gun-sided, lying, lobe and a screen-sided lobe and comprises a first, inner winding sub-assembly and a second, outer winding sub-assembly, each winding sub-assembly comprising two longitudinal conductor groups arranged at both sides of the tube, which groups are connected at their screen side by a connection group crossing in the plane of the screen-sided lobe, the second sub-assembly surrounding the first sub-assembly in such a way that one single, wedge-shaped window with its narrower side at the gun side is formed between the sub-assemblies at the gun side.

2. A display tube as claimed in claim 1, characterized in that, viewed in a plane transverse to the longitudinal tube axis, the longitudinal conductor groups, arranged at both sides of the tube, of the second sub-assembly subtend an angle of less than 120° with respect to the tube axis proximate to the wider side of the wedge-shaped window.

3. A display tube as claimed in claim 1, characterized in that the display screen has an aspect ratio which is larger than 4:3, particularly 14:9 or 16:9.

4. A display tube as claimed in claim 3, in which the electron beams are produced in a plane parallel to the short axis, characterized in that the line deflection coil system is arranged for deflection along the short axis.

* * * * *